United States Patent [19]

Hasemann et al.

[11] 4,330,960

[45] May 25, 1982

[54] CLOSING ARRANGEMENT FOR SLIDING DOORS AND THE LIKE

[75] Inventors: Werner Hasemann, Schwerte; Herbert Cleff, Ennepetal, both of Fed. Rep. of Germany

[73] Assignee: Dorma-Baubeschlag GmbH & Co. KG., Ennepetal-Voerde, Fed. Rep. of Germany

[21] Appl. No.: 104,905

[22] Filed: Dec. 18, 1979

[51] Int. Cl.[3] ..... E05G 15/06

[52] U.S. Cl. ..... 49/404; 49/360; 16/78

[58] Field of Search ..... 49/274, 404, 360, 361; 16/63, 78

[56] References Cited

U.S. PATENT DOCUMENTS

| | | | |
|---|---|---|---|
| 1,289,211 | 12/1918 | Lovejoy | 49/360 |
| 1,632,237 | 6/1927 | Lemon | 49/360 |
| 3,344,556 | 10/1967 | Edwards | 49/360 |

FOREIGN PATENT DOCUMENTS

| | | | |
|---|---|---|---|
| 2644539 | 4/1978 | Fed. Rep. of Germany . | |
| 2800008 | 7/1979 | Fed. Rep. of Germany | 49/360 |

*Primary Examiner*—Kenneth Downey

*Attorney, Agent, or Firm*—Michael J. Striker

[57] ABSTRACT

Closing arrangement for sliding doors adapted to move between closed and open positions along a lengthwise guide track. The arrangement includes a rotor operatively connected with connecting links connected to the door and arranged to move along the guide track. Brake arrangement is mounted with a drive member mounted in coaxial alignment with the rotor shaft. The closing arrangement is provided with a coupling device which is operatively connected to the rotor shaft and comprises an electromagnetic coupling and a friction coupling mounted on a common shaft. The coupling device prevents an inadvertant backward movement of the open sliding door to its closed position.

11 Claims, 3 Drawing Figures

CLOSING ARRANGEMENT FOR SLIDING DOORS AND THE LIKE

BACKGROUND OF THE INVENTION

Field of the Invention

The invention relates to closing arrangements provided for sliding doors and analogous elements which are adapted to move to a closed position along the lengthwise tracks by a driving force applied to rod-like connecting links engaged to a rotor and having a drag arrangement for limiting the closing speed of the door in its operation.

A conventional closing arrangement known from the German Pat. No. 668,313 involves a device, wherein a closing force applied to the sliding door is transmitted through connecting links to a chain which is connected to the door at one side, and to a winding drum at the other side. In order to restrict the closing speed of the sliding door the chain is placed about a sprocket which during door closing movement is connected through a gear transmission with a bladed rotor. Due to the high transmission ratio of the gear transmission the rotor turns at high speed and slows down the movement of the chain and consequently of the door due to the air drag acting upon the rotor blades.

During the opening movement of the sliding door the rotor does not rotate, because the sprocket actuates a ratchet and a ratchet pawl that prevent transmission of motion to the rotor. In its fully open position, the slidable door is subjected to the action of a mechanical ratchet device which holds the door in its opening position in which the bladed rotor is arrested by a spring-biased locking element. A pendulum is provided in the arrangement to delay disengagement of the locking element from the rotor, so that the sliding door remains in its open position for a predetermined short period of time, whereafter the door automatically returns to closed position which being retarded by the rotor. However, it is disadvantageous in this known closing arrangement that the sliding door can remain open only when it is in its fully open position, and that the period during which it remains open is strictly limited. If the door is required to open only partially, then it must be manually held by an operator, because otherwise it will immediately return to its closed position.

SUMMARY OF THE INVENTION

It is an object of the present invention to provide an improved closing arrangement for sliding doors or the like which holds the door in any desired random open position independently, and provides independent movement in the closing direction of the door from any such open position.

This and other objects of the invention are achieved by coupling means including an electromagnetic coupling which transmits a torsional moment to a coupling device including a series of couplings one of which is a friction coupling, said coupling means being connected to a rotor operatively connected to link connections adapted to move the sliding door from its closed to its open position. The torsional moment provided by the friction coupling is somewhat larger than the moment provided by a force applied to the door for moving the same in closing direction, and the electromagnetic coupling connected to the friction coupling is arranged so that the open door remains stationary in each desired open position. Only when a closing load is manually applied to the door, will the torsional moment of the friction coupling be overcome to permit the sliding door to move to its closing position. If, with door in an open position, the electromagnetic coupling is disconnected fromthe friction coupling the torque stored in an energy storing device suffices to move the door to closed position counter to the action of a brake arrangement which retards the speed of the door closing movement. The opening of sliding doors is not a problem, because in the direction of the opening movement the coupling device with the series of couplings is disengaged. It is another advantage of the present invention, that a compact construction is achieved which requires a relatively small space and is suitable for installation in all sliding doors employed in the industry, even in already existing doors as retrofitting equipment. It is also advantageous for the invention that between the rotor and an inlet section of an electromagnetically controllable coupling a friction coupling is arranged which transmits a limited torque.

To more reliably hold sliding doors in their open positions the electromagnetic coupling employed in this arrangement is of the type controllable by a latching current.

It is another point of this invention that the electromagnetic coupling and the friction coupling may be coaxially aligned. For this, a common axis of rotation for the electromagnetic coupling and the friction coupling is preferably provided which is parallel to the rotor axis of rotation, whereby transmission of the torsional moments between the rotor and the coupling device is preferably transmitted by a chain drive connecting the rotor and an input of the coupling device. The electromagnetic coupling may be released to permit the sliding door to perform its return movement from open position. For this purpose the rotor is provided with a flat spiral spring incorporated in the rotor, so that one end of the spring is fixed, and the other end is fixed, preferably readjustably so that it can be retensioned. In the preferred embodiment of the invention one end of the spring is preferably connected to a frame through an inner socket, so that the spring could be braced without shifting or displacement of the sliding door. This is important during the assembly or repairing of the arrangement.

When the sliding door is moved in its opening direction the spring force for the displacement and further opening of the door should be overcome in addition to overcoming of friction forces of the sliding door and forces in friction coupling, and for this purpose a freewheeling arrangement is employed in this apparatus between the rotor and an inlet member of the coupling device which is operable in the door closing movement and is disengaged in the door opening movement. An outlet member of the freewheeling arrangement is mounted within the rotor, and is operatively connected to an inlet member of the coupling device.

To provide a compact assembly in accordance with the present invention a rotor axis and an axis of rotation of the drag arrangement are arranged coaxially. The shaft axis of the rotor is preferably rigidly connected to the axis of the drag arrangement driving member.

DESCRIPTION OF THE PREFERRED EMBODIMENTS

Figure 1:
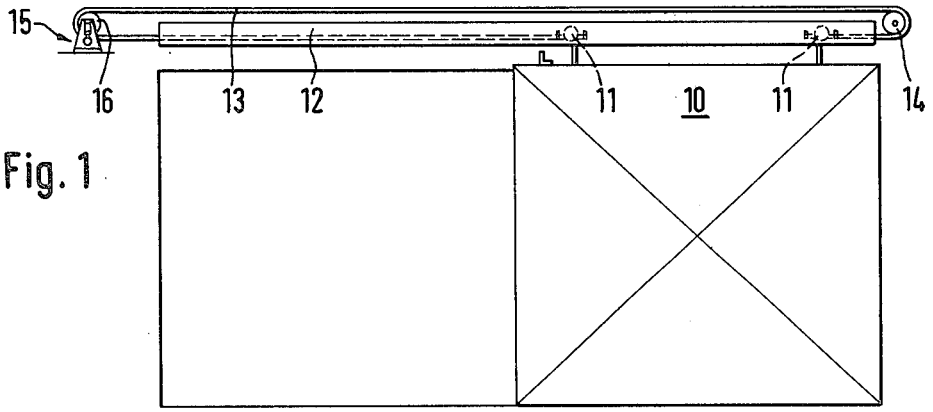
FIG. 1 is a schematic view of a closing arrangement for a sliding door in accordance with the invention.

Referring to FIG. 1, a sliding door 10 shown in its open position is slidably moved along a guide rail or track 12. Rotation rollers 11 are connected to the door. A connecting link e.g., in a form of gear belt 13, is arranged to move along a lateral roller 14 and a rotor 16, so that axial movement of the door causes a rotational movement of the rotor 16.

Figure 2:
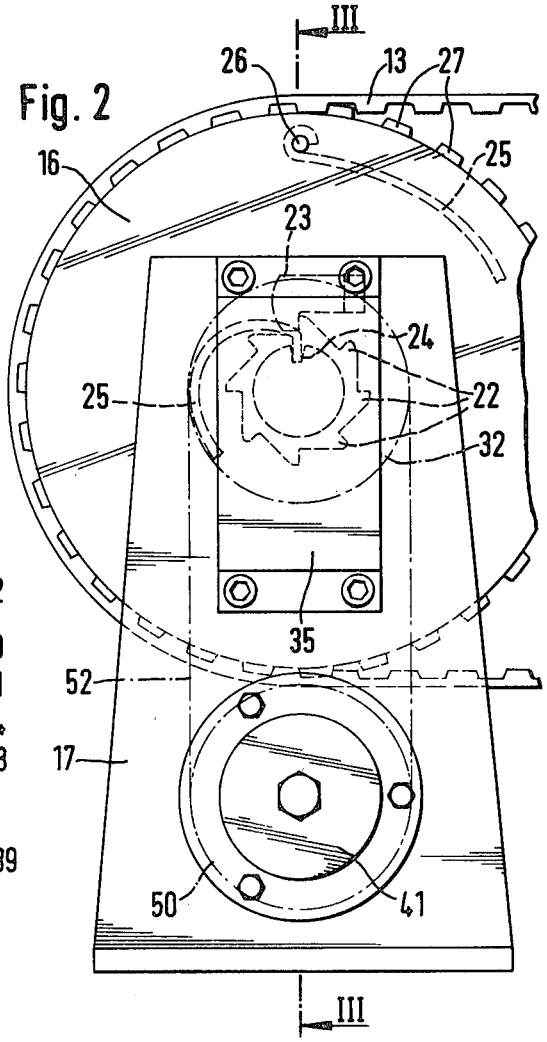
FIG. 2 is an enlarged elevational view of the closing arrangement shown in FIG. 1.

A closing arrangement 15 includes a frame 17 in which two axles 19 and 43 are positioned parallel to each other. In the upper part of the frame 17 an axle or shaft 19 is located within a roller bearing 18. A rotor 16 having a hub 20 is mounted on the shaft 19. The hub 20 of rotor 16 is embraced by an inner socket 21 the lateral outwardly extending part of which is provided with ratchet teeth 22. A loaded ratchet pawl 23 as can be seen in FIG. 2 is pivotally mounted on the frame 17 for engagement with ratchet teeth 22. The inner socket 21 has a recess 24, also shown in FIG. 2 to engage an inner end of a flat spiral spring 25 which is used in this arrangement as a force accumulator. The outer end of spiral spring 25 which is located within the hub 20 of a drum-shaped rotor 16 is mounted in the area of the periphery of the rotor and is rigidly supported by transversally extending pins 26. The outer periphery of the rotor 16 is provided with gear teeth 27 arranged to engage the links of the gear belt 13 so that force provided by the flat spiral spring 25 may be transmitted to the links of gear belt. The shaft 19 has an axially extending section 28 connected at one side with an outlet 30 of a freewheeling arrangement 29 and at the other side with a sprocket of a transmission member 32 connected to a coupling device 27. The outlet member 30 and an inlet member 31 of freewheeling arrangement 29 are connected to rotor 16 so that the inlet member 31 is coupled to rotor, as for example by pressing the same within an opening provided in the rotor. Freewheeling arrangement 29 is provided in a conventional manner with rollers positioned between inlet member 31 and outlet member 30 so that during the closing movement of the sliding door and under tension of the spiral spring 25 the rotation of the inlet member 31 is transmitted through rollers to the outlet member 30. The shaft 19 has a notch 33 arranged at a front surface thereof with which a catch 34 of a drive element 36 of a drag arrangement 35 is engaged. The drag arrangement 35 counteracts the spiral spring force so that the movement of the sliding door 10 during its closing path may be slowed down. The brake arrangement 35 is mounted on the frame 17 by any conventional fastener means and rigidly connected thereto so that drive element 36 and shaft 19 are coaxially aligned.

Figure 3:
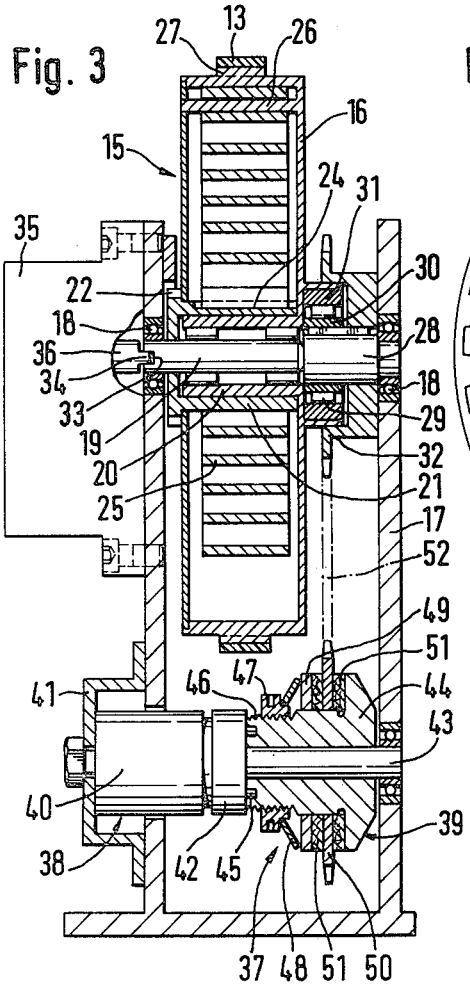
FIG. 3 is an enlarged sectional view taken along line III—III of FIG. 2.

Within the frame 17, beneath the rotor 16, freewheeling arrangement 29 and sprocket 32 which all are mounted on the shaft 19, a coupling device 37 is located. The coupling device includes an electromagnetic coupling 38 and coaxially positioned thereto a friction coupling 39. In accordance with the preferred embodiment, as can be seen in FIG. 3, the electromagnetic coupling 38 has an outlet portion 40 attached to the frame 17 and rigidly fixed to a support enclosure 41. An inlet portion 42 of electromagnetic coupling 38 is also positioned in a lower part of the frame 17 on a shaft 43 which carries a friction coupling casing 44 of a friction coupling 39. The inlet portion 42 is connected to friction coupling housing 44, as for example by journals 45. Outer threads 46 are provided on the outer peripheral surface of the coupling casing 44 which supports a nut 47. A spring washer 48 is arranged between the nut 47 and a support ring 49 mounted on the coupling casing 44 whereby between support ring 49 and brackets of coupling casing 44 a sprocket 40 is rotatably supported on the casing 44 as an inlet member of the coupling device 37. Friction rings 51 may be positioned between sprocket 50 and casing brackets at one side, and between sprockets 50 and spring washer 48 at the other side to increase friction action in the arrangement. The sprocket 32 connected to rotor 16 through the freewheeling arrangement 29 and the sprocket 50 connected to the inlet member of the coupling device 37 are bound by a chain 52 of the chain drive. Nut 47, spring washer 48 and support ring 49 actuate a counter pressure force to adjustably stop the sprocket 50 so that a required transmitting torsional moment of the friction coupling is provided.

In operation, when the sliding door 10 is sliding, by force provided by any conventional means for example by hand of an operator, from its closed position, as can be seen in FIG. 1, to its open position, the gear belt will rotate the rotor in a counter clockwise direction. A lower end of the flat spiral spring 25 is held in the frame 17 through the inner socket 21, while rotating pins 26 holding the outer end of the spring 25 are tightened in a counter clockwise direction. The inlet member 31 and the outlet member 30 of the freewheeling arrangement remain disengaged relative to each other so that no rotational movement is translated from rotor 16 to the sprocket 32 and thus to sprocket 50.

If the sliding movement of the door 10 in direction to open position is interrupted, in the freewheeling arrangement 29 inlet member 31 and the outlet member 30 which become connected to each other through rollers are fixed, so that door 10 remains in its once-interrupted intermediate position because the electromagnetic coupling 38 and the inlet portion 42 of the friction coupling 37 are connected to each other by a latching current and the housing 44 of the coupling 37 remains immovable; no force is applied at this time to the sprocket 32 and thus to the spring 25, and the door 10 is held in said intermediate position by the engaged inlet member 31 and outlet member 30. The door 10 may be opened further only when an actuating force in the direction to the opening position will be exercised. If sliding door 10 must be directed back in its closing position when the electromagnetic coupling is stopped, the actuating force must be used on the door in its closed direction which should be sufficient to overcome the force of the flat spiral spring 25 together with the stable torsional moment of friction coupling 39. At this time when sufficient force (by a hand of an operator) is applied to the door 10 in its closed direction rotor 16 and therefore shaft 19 will rotate in clockwise direction causing via the freewheeling arrangement 29 the rotation of sprocket 32, chain 52 and sprocket 50 (the friction forces of friction rings 51 are overcome by the force of the operator) so that the door will slide to its closed position.

In open position of the sliding door 10 electromagnetic coupling 38 is disconnected by latching current, so that outlet portion 40 and inlet portion 42 are disengaged, the door 10 through the gearbelt 13 and rotor 16 and spiral spring 25 actuated by outer force is moved in a closed direction. Simultaneously with this action, the brake arrangement 36 is rotated in clockwise direction through engaged freewheeling arrangement 29 and shaft 19, so that the closing movement is slowing down and closing speed does not exceed a predetermined level. In this case the sprocket 32 rotated with shaft 19 turns chain 52 and sprocket 50 whereby, friction coupling 39, and inlet portion 42 of electromagnetic coupling 38 will be loosely rotated on shaft 43 so that the sliding door 10 will slide to its closed position.

A spring force of the flat spiral spring remains within required limits and is provided by means of a special wrench used to turn inner socket 21 in clockwise direction. This can be obtained during assembling or repairing of the closing arrangement.

In the other embodiments within the scope of the present invention, as for example, electromagnetic coupling 38 and friction coupling 39 can be interchanged in their mounting position, and friction coupling 39 may be arranged as stationary member with which a movable end portion of electromagnetic coupling is connected, the other end of the electromagnetic coupling may be operatively connected with rotor 16. The links of the gear belt may load as for example, a chain, and closing arrangement may be mounted on the sliding door, and an outer gearing circuit of the rotor 16, may be arranged in the area of the guide rail. Furthermore, the coupling device 37 may be mounted coaxially with rotor 16, so that a chain transmission would not be necessary in the assembly.

It will be understood that each of the elements described above or two or more together may also find a useful application in other types of constructions differing from the types described above.

While the invention has been illustrated and described as embodied in an arrangement for a closing arrangement, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A closing arrangement for sliding doors or similar elements of the type adapted to slidably move between closed and open positions by a driving force applied to elongated connecting links for moving the door along a lengthwise track, comprising a frame; a rotor having an axis of rotation and operatively connected to said connecting links so that the sliding movement of the door causes a rotation movement of said rotor; a force accumulating flat spiral spring mounted within said rotor for providing a torsional moment of said rotor and having two ends, one end of said spring being rigidly supported on said frame and the other end thereof being tightly clamped on said rotor; brake means operatively connected to said rotor for limiting the closing speed of the sliding door; and coupling means operatively connected to said rotor for preventing the open sliding door from moving inadvertantly backward to its closed position, said coupling means including an electromagnetic coupling and a friction coupling connected thereto, said friction coupling being arranged to limit the torsional moment of said rotor.

2. The closing arrangement of claim 1, wherein said electromagnetic coupling is rigidly connected to a support enclosure attached to said frame.

3. The closing arrangement of claim 1, wherein said electromagnetic coupling includes an inlet portion and an outlet portion connected to said friction coupling.

4. The closing arrangement of claim 1, wherein said electromagnetic coupling and said friction coupling are arranged on a common axis.

5. The closing arrangement of claim 4, wherein said common axis is arranged parallel to said axis of rotation of said rotor.

6. The closing arrangement of claim 5, wherein a chain drive is provided between said axis of rotation of said rotor and an inlet member arranged on said friction coupling.

7. The closing arrangement of claim 1, wherein said one end of said spring is its inner end rigidly connected to a support socket secured to said frame.

8. The closing arrangement of claim 1, wherein a freewheeling device is provided, arranged between said rotor and said friction coupling, and positioned on said axis of rotation of said rotor, said freewheeling device is engaged when the sliding door is in its closing movement and is dissengaged when the sliding door is in its open movement.

9. The closing arrangement of claim 8, said friction coupling carrying a first sprocket, said freewheeling device including an outlet member connected to said rotor, the arrangement further including a transmission member operatively connected to said outlet member and carrying a second sprocket and a chain interconnected between said first and second sprockets, said transmission member being operative for engaging or disengaging said axis of rotation from said friction coupling.

10. The closing arrangement of claim 1, wherein said brake means include a driving member, said drive member is arranged in coaxial alignment with said axis of rotation of said rotor.

11. The closing arrangement of claim 10, wherein said axis of rotation is rigidly connected to the axis of said drive member.

* * * * *